US012760944B2

(12) United States Patent
Fagundes et al.

(10) Patent No.: US 12,760,944 B2
(45) Date of Patent: Oct. 13, 2026

(54) MOTOR COOLING USING IMPINGEMENT JETS CREATED BY PERFORATED COOLING JACKET

(71) Applicant: DANFOSS A/S, Nordborg (DK)

(72) Inventors: Tadeu Mendonca Fagundes, Tallahassee, FL (US); Jin Yan, Tallahassee, FL (US); Lin Xiang Sun, Tallahassee, FL (US)

(73) Assignee: DANFOSS A/S, Nordborg (DK)

( * ) Notice: Subject to any disclaimer, the term of this patent is extended or adjusted under 35 U.S.C. 154(b) by 202 days.

(21) Appl. No.: 18/032,890

(22) PCT Filed: Nov. 11, 2021

(86) PCT No.: PCT/US2021/058932
§ 371 (c)(1),
(2) Date: Apr. 20, 2023

(87) PCT Pub. No.: WO2022/119698
PCT Pub. Date: Jun. 9, 2022

(65) Prior Publication Data

US 2023/0392836 A1 Dec. 7, 2023

Related U.S. Application Data

(60) Provisional application No. 63/120,250, filed on Dec. 2, 2020.

(51) Int. Cl.
*F25B 31/00* (2006.01)
*F04B 39/06* (2006.01)
(Continued)

(52) U.S. Cl.
CPC ..... *F25B 31/006* (2013.01); *F04B 39/064* (2013.01); *F04D 17/10* (2013.01); *F04D 25/06* (2013.01); *F04D 29/5806* (2013.01)

(58) Field of Classification Search
CPC ... F04D 29/5806; F04D 29/582; H02K 5/203; H01L 23/4735; F25B 31/006;
(Continued)

(56) References Cited

U.S. PATENT DOCUMENTS 2,597,243 A 5/1952 Hubacker et al.
4,573,324 A 3/1986 Tischer et al.
(Continued)

FOREIGN PATENT DOCUMENTS

CN 201015762 Y 2/2008
DE 102005018817 A1 * 10/2006 ..... F28F 9/10
(Continued)

*Primary Examiner* — Jianying C Atkisson
*Assistant Examiner* — For K Ling
(74) *Attorney, Agent, or Firm* — Carlson, Gaskey & Olds, P.C.

(57) ABSTRACT

A refrigerant compressor according to an exemplary aspect of the present disclosure includes, among other things, a cooling jacket including a plurality of perforations configured to cause refrigerant flowing through the perforations to form impingement jets and further configured to direct the impingement jets onto a surface adjacent a stator. The refrigerant compressor may be used in a heating, ventilation, and air conditioning (HVAC) chiller system, for example.

4 Claims, 3 Drawing Sheets

(51) Int. Cl.
*F04D 17/10* (2006.01)
*F04D 25/06* (2006.01)
*F04D 29/58* (2006.01)

(58) Field of Classification Search
CPC ..... F04B 39/064; F28F 9/0265; F28F 9/0226; F28F 9/027; F28F 9/026; F28F 3/10; F28D 9/0012
See application file for complete search history.

(56) References Cited

U.S. PATENT DOCUMENTS 6,459,581 B1 * 10/2002 Newton ..... H01L 23/4735 257/715
7,017,654 B2 * 3/2006 Kenny ..... H01L 21/4871 174/15.1
8,304,940 B2 * 11/2012 Murakami ..... H02K 3/24 310/58
2003/0024689 A1 * 2/2003 Nakahama ..... F28F 3/12 165/80.4
2007/0063592 A1 * 3/2007 Pashnik ..... B60L 50/16 310/54
2008/0100159 A1 * 5/2008 Dawsey ..... H02K 1/20 310/59
2008/0115527 A1 * 5/2008 Doty ..... F25B 31/006 62/505
2010/0181873 A1 * 7/2010 Kern ..... H02K 5/06 164/6
2012/0025638 A1 * 2/2012 Palafox ..... H02K 9/10 310/52
2012/0133222 A1 * 5/2012 Han ..... H02K 9/19 310/58
2012/0318479 A1 * 12/2012 Chang ..... H02K 5/15 165/104.19
2013/0002064 A1 * 1/2013 De Bock ..... H02K 9/197 310/54
2013/0209239 A1 * 8/2013 Karlsson ..... F01D 25/12 415/117
2014/0084721 A1 * 3/2014 Pal ..... H02K 5/207 310/59
2014/0284787 A1 * 9/2014 Joshi ..... F28D 15/00 257/714
2015/0207378 A1 * 7/2015 Buttner ..... F28D 15/00 29/890.035
2015/0249379 A1 * 9/2015 Wirsch, Jr. ..... H02K 5/203 310/54
2017/0092565 A1 * 3/2017 Chen ..... H05K 7/20281
2020/0244123 A1 * 7/2020 Kang ..... H02K 9/19

FOREIGN PATENT DOCUMENTS

WO WO-2005117108 A1 * 12/2005 ..... H01L 23/4735
WO 2009101167 A1 8/2009

* cited by examiner

MOTOR COOLING USING IMPINGEMENT JETS CREATED BY PERFORATED COOLING JACKET

RELATED APPLICATIONS

This application claims the benefit of U.S. Provisional Application No. 63/120,250, filed Dec. 2, 2020, the entirety of which is herein incorporated by reference.

TECHNICAL FIELD

This disclosure relates to a motor cooling scheme in which the motor is cooled using impingement jets created by a perforated cooling jacket. The motor may be used in a compressor, such as a refrigerant compressor, which in turn may be used in a heating, ventilation, and air conditioning (HVAC) chiller system, for example.

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to pressurize refrigerant. The at least one impeller is mounted to a rotatable shaft. The motor in some examples is an electric motor including a rotor and a stator. In one known example the motor is cooled by circulating refrigerant about the stator, to cool the stator, and then directing that refrigerant between the rotor and the stator to cool the rotor. After cooling the rotor, the refrigerant is returned to a refrigeration loop.

SUMMARY

A refrigerant compressor according to an exemplary aspect of the present disclosure includes, among other things, a cooling jacket including a plurality of perforations configured to cause refrigerant flowing through the perforations to form impingement jets and further configured to direct the impingement jets onto a surface adjacent a stator.

In a further embodiment, the surface adjacent the stator is a cooling plate covering the stator.

In a further embodiment, the cooling plate is formed integrally with the stator.

In a further embodiment, the cooling jacket is arranged radially between the cooling plate and a radially outer housing of the refrigerant compressor.

In a further embodiment, the cooling jacket is arranged such that a radial gap is provided between a radially outer surface of the cooling jacket and a radially inner surface of the radially outer housing, and such that a radial gap is also provided between a radially inner surface of the cooling jacket and a radially outer surface of the cooling plate.

In a further embodiment, the refrigerant compressor includes a support arrangement holding the cooling jacket in place relative to the cooling plate and the radially outer housing.

In a further embodiment, the support arrangement incudes a plurality of supports circumferentially spaced-apart from one another.

In a further embodiment, the supports are attached to the cooling jacket and extend to the cooling plate and the radially outer housing.

In a further embodiment, the supports are attached adjacent ends of the cooling jacket.

In a further embodiment, there are four supports.

In a further embodiment, the perforations permit refrigerant to flow from the radially outer surface of the cooling jacket to the radially inner surface of the cooling jacket.

In a further embodiment, the perforations are substantially equally-sized and evenly-distributed on the cooling jacket.

In a further embodiment, the perforations each exhibit a diameter within a range of 0.5 mm and 1.5 mm.

In a further embodiment, the perforations are spaced-apart by distance between 2 mm and 4 mm.

A method according to an exemplary aspect of the present disclosure includes, among other things, impinging refrigerant on a surface adjacent a stator of a motor for a refrigerant compressor by causing the refrigerant to flow through a cooling jacket including a plurality of perforations. The perforations are configured to cause refrigerant flowing through the perforations to form impingement.

In a further embodiment, the surface adjacent the stator is a cooling plate covering the stator.

In a further embodiment, the cooling plate is formed integrally with the stator.

In a further embodiment, the impinging step includes first causing refrigerant to flow in a gap provided between a radially outer surface of the cooling jacket and a radially inner surface of a radially outer housing of the refrigerant compressor, and then directing the refrigerant through the perforations such that the refrigerant flows into a radial gap provided between a radially inner surface of the cooling jacket and a radially outer surface of the cooling plate.

In a further embodiment, the perforations are substantially equally-sized and evenly-distributed on the cooling jacket.

In a further embodiment, the perforations each exhibit a diameter within a range of 0.5 mm and 1.5 mm and the perforations are spaced-apart by distance between 2 mm and 4 mm.

DETAILED DESCRIPTION

Figure 1:
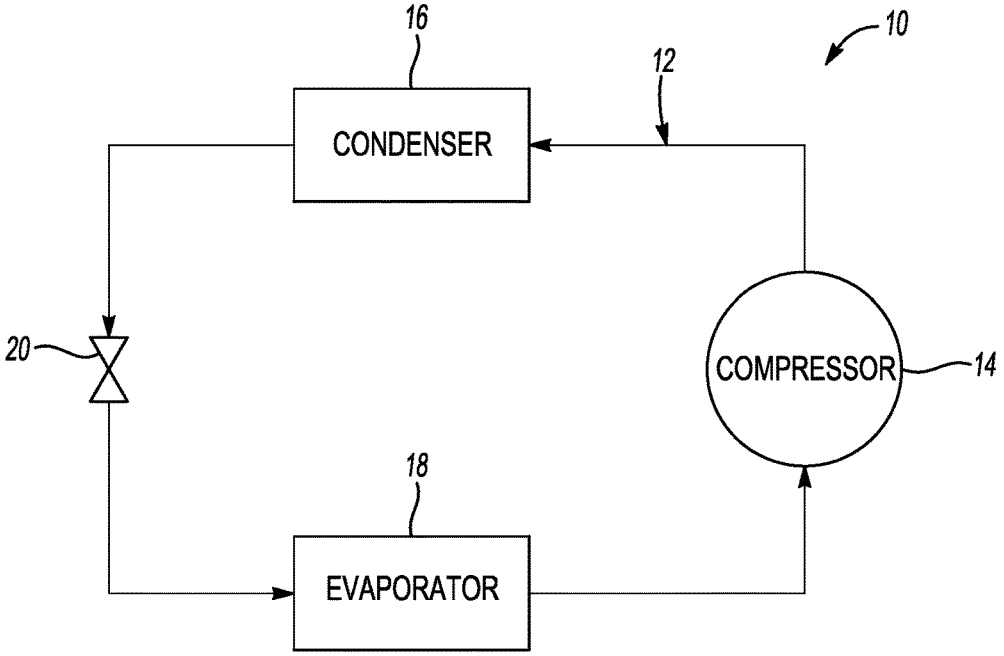
FIG. 1 schematically illustrates an example refrigerant system.

FIG. 1 illustrates a refrigerant system 10. The refrigerant system 10 includes a main refrigerant loop, or circuit, 12 in communication with a refrigerant compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
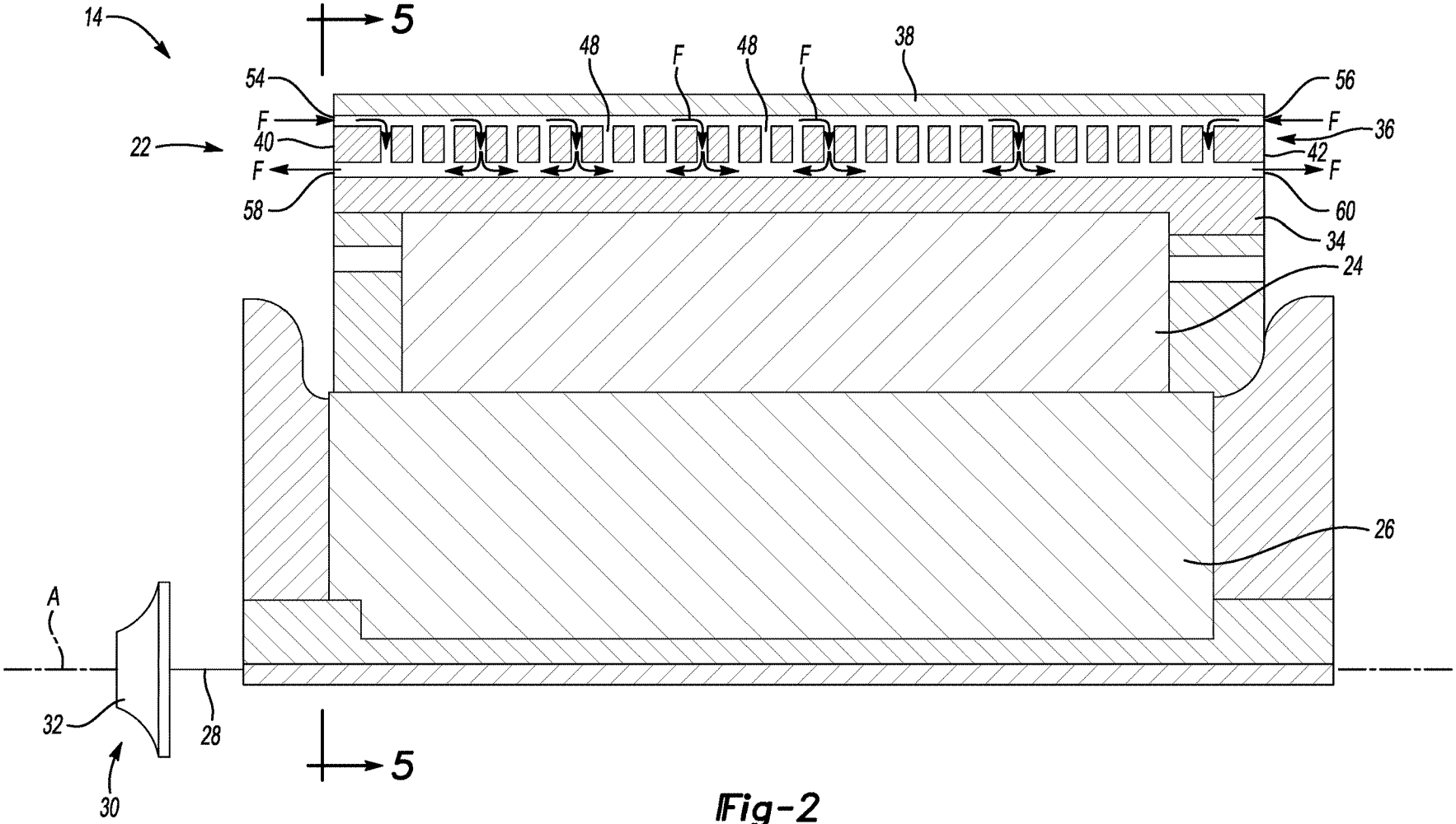
FIG. 2 is a cross-sectional and somewhat schematic view of a portion of an example compressor.

FIG. 2 illustrates, in cross-section, a portion of the compressor 14. The compressor 14 includes an electric motor 22 having a stator 24 arranged radially outside of a rotor 26. The rotor 26 is connected to a shaft 28, which rotates to drive at least one compression stage 30 of the compressor 14, which in this example includes at least one impeller 32. The compressor 14 may include multiple compression stages, including an axial compression stage and/or a radial compression stage. When the compressor 14 includes both an axial compression stage and a radial compression stage, the compressor 14 may be referred to as a mixed flow compressor. This disclosure extends to compressors other than mixed flow compressors.

The shaft 28 and impeller 32 are rotatable by the electric motor 22 about an axis A to compress refrigerant. The terms axial and radial in this disclosure are used relative to the axis A. The shaft 28 may be rotatably supported by a plurality of bearing assemblies, which may be magnetic bearing assemblies. During operation of the compressor 14, the electric motor 22 may generate significant heat. The electric motor 22, in this example, is cooled by refrigerant F from the refrigerant system 10. In this respect, the compressor 14 is free of oil.

This disclosure specifically relates to a thermal transfer arrangement, and in particular a cooling arrangement, for the stator 24. More specifically, this disclosure relates to a cooling arrangement configured for use adjacent a radially outer surface of the stator 24.

In the example of FIG. 2, radially outward of the stator 24, the stator 24 is covered by a cooling plate 34. A separate cooling plate 34 is not required in all examples. For instance, the cooling plate 34 could be formed integrally with the stator 24. A cooling jacket 36 is arranged radially between the cooling plate 34 and a radially outer housing 38 of the compressor 14.

Figure 3:
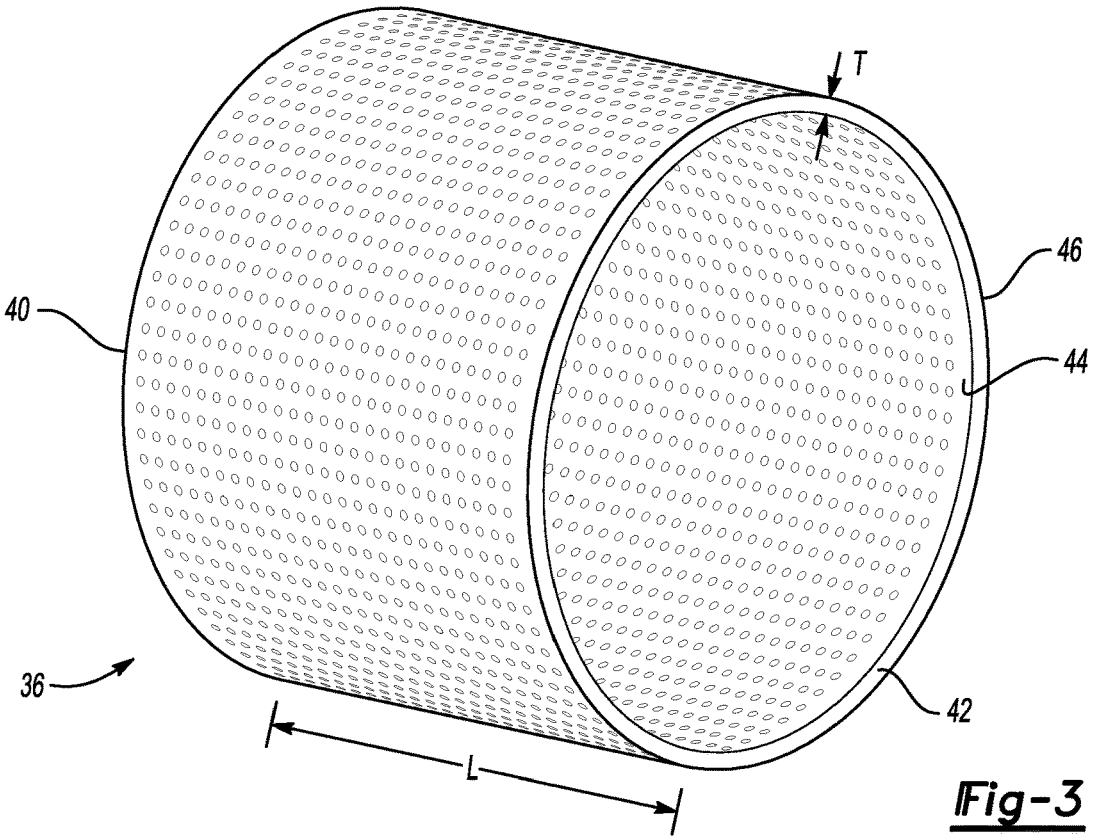
FIG. 3 is a perspective view of an example cooling jacket.
Figure 4:
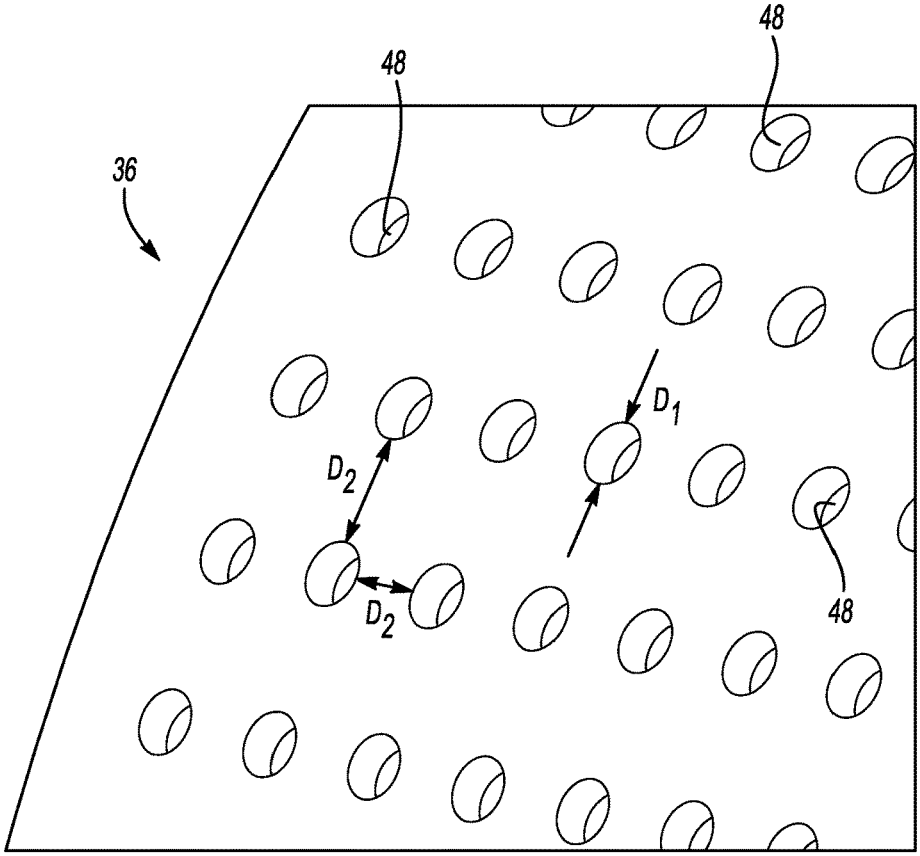
FIG. 4 is a close-up view of a portion of the cooling jacket.

The cooling jacket 36 is shown in more detail in FIGS. 3 and 4. As shown, the cooling jacket 36 resembles a hollow cylinder and has a length L between a first end 40 and a second end 42 opposite the first end 40. The cooling jacket 36 is centered around the axis A and extends circumferentially about the entirety of the axis A. The cooling jacket 36 is symmetrical about the axis A. The cooling jacket 36 includes a thickness T between a radially inner surface 44 of the cooling jacket 36 and a radially outer surface 46 of the cooling jacket 36. The thickness T is set such that there is a radial gap between a radially outer surface 46 and a radially inner surface of the housing 38, and further such that there is a radial gap between a radially outer surface of the cooling plate 34 and the radially inner surface 44. The radial gaps may be equal to one another or they may be differently-sized. In a particular example, the radially outer gap is of a smaller radial dimension than the radially inner gap.

The cooling jacket 36 includes a plurality of perforations 48 extending radially through the cooling jacket 36. The perforations 48 are radially-extending through-holes that permit the refrigerant F to flow from the radially outer surface 46 to the radially inner surface 44 through the perforations 48. In this example, the perforations 48 are substantially equally-sized and substantially evenly distributed on the cooling jacket 36. In particular, the perforations 48 each have diameter $D_1$, which in one example is within a range of 0.5 mm and 1.5 mm, and the perforations 48 are spaced-apart from one another in all directions by a relatively constant distance $D_2$, which is between 2 mm and 4 mm. While a particular perforation diameter size and relative spacing has been mentioned, this disclosure is not limited to a particular perforation diameter and/or distribution.

The cooling jacket 36 may be formed using known techniques. In an example, the cooling jacket 36 is originally formed as a rectangular sheet of metal having the thickness T. The perforations 48 may be provided by drilling, boring, etc., in the rectangular sheet. The rectangular sheet can then be cut to size, rolled to resemble a hollow cylinder, and the ends of the sheet can then be welded together, as one example.

Figure 5:
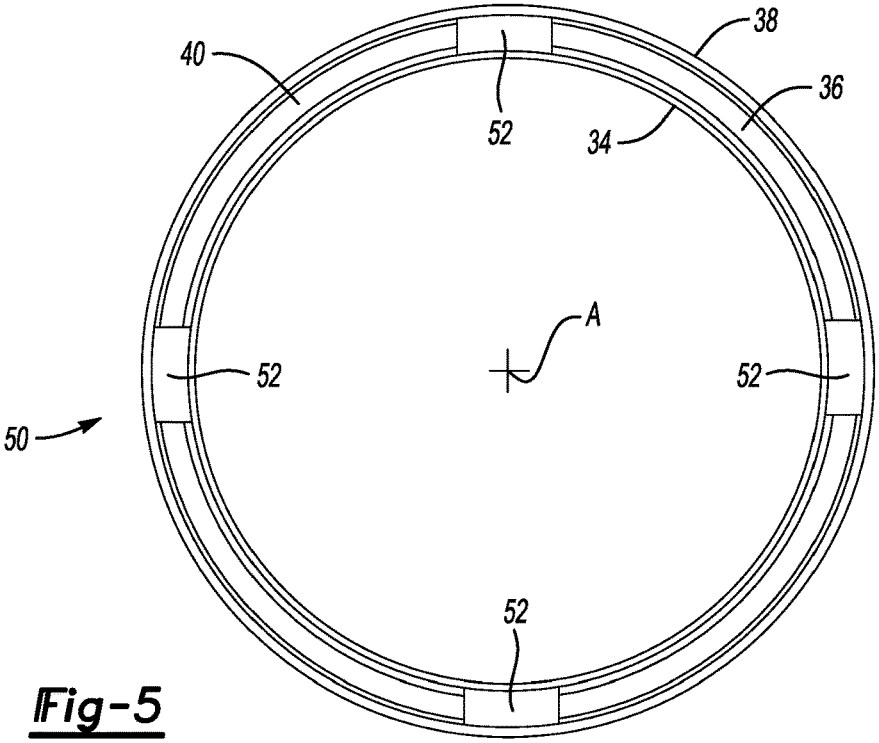
FIG. 5 is an end view of a portion of the compressor, and illustrates an example support arrangement relative to the cooling jacket.

The cooling jacket 36 is held in place relative to the cooling plate 34 and/or the housing 38 using a support arrangement. Instead of the cooling plate 34, the cooling jacket 36 could additionally or alternatively be held in place relative to the stator 24. FIG. 5 illustrates an example support arrangement 50 including a plurality of supports 52, specifically four supports, which are equally spaced-apart from one another about the axis A. Each support 52, in this example, extends radially from the cooling plate 34 to the housing 38. The supports 52 are attached to the cooling jacket 36 adjacent the first and second ends 40, 42 and, optionally, at one or more other locations axially between the first and second end 40, 42. In FIG. 5, four supports 52 are shown attached to the cooling jacket 36 adjacent the first end 40. A similar arrangement of supports 52 is also provided adjacent the second end 42 and, optionally, at the other axial locations. The supports 52 may be welded to the cooling plate 34, cooling jacket 36, and the housing 38.

In an example method of use, during operation of the compressor 14, refrigerant F flows into the electric motor 22 from the condenser 16. Within the electric motor 22, refrigerant F flows into a gap radially between the radially outer surface 46 and the housing 38 at inlet locations 54, 56 adjacent the first and second ends 40, 42 of the cooling jacket 36. Refrigerant F then flows through the perforations 48. The perforations 48 essentially transform the flow of refrigerant F into impingement jets, and causes the refrigerant F to flow at a relatively high speed radially toward the cooling plate 34 such that the refrigerant F impinges on the radially outer surface of the cooling plate 34. Doing so leads to relatively effective heat transfer between the refrigerant F and the stator 24. After contacting the cooling plate 34, the refrigerant F flows axially within the radial space between the radially inner surface 44 and the cooling plate 34 toward the first and second ends 40, 42 where the refrigerant F flows to outlet locations 58, 60. Downstream of the outlet locations 58, 60, the refrigerant F may flow to a secondary cooling location, such as another location within the electric motor 22 requiring cooling, namely toward the rotor 26.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A method, comprising:

impinging refrigerant on a surface adjacent a stator of a motor for a refrigerant compressor by causing the refrigerant to flow through a cooling jacket including a plurality of perforations arranged such that the refrigerant flows through the perforations in parallel, wherein the perforations are configured to cause the refrigerant flowing through the perforations to form impingement jets; and directing some of the refrigerant downstream of a first axial end of the stator by causing some of the refrigerant to flow, following impingement, along a substantially axially-straight path in a first axial direction past the first axial end of the stator, and directing other refrigerant downstream of a second axial end of the stator opposite the first axial end by causing the other refrigerant to flow, following impingement, along a substantially axially-straight path in a second axial direction opposite the first axial direction past the second axial end of the stator.

2. The method as recited in claim 1, wherein the surface adjacent the stator is a cooling plate covering the stator.

3. The method as recited in claim 2, wherein the cooling plate is formed integrally with the stator.

4. The method as recited in claim 2, wherein the impinging step includes first causing refrigerant to flow in a gap provided between a radially outer surface of the cooling jacket and a radially inner surface of a radially outer housing of the refrigerant compressor, and then directing the refrigerant through the perforations such that the refrigerant flows into a radial gap provided between a radially inner surface of the cooling jacket and a radially outer surface of the cooling plate.

* * * * *